United States Patent [19]

Lambert, Jr. et al.

[11] 4,349,193

[45] Sep. 14, 1982

[54] LOWER ABDOMINAL TWIST MACHINE

[76] Inventors: Lloyd J. Lambert, Jr.; Lloyd J. Lambert, Sr., both of 1538 College Ave., South Houston, Tex. 77587

[21] Appl. No.: 164,168

[22] Filed: Jun. 30, 1980

[51] Int. Cl.[3] ..... A63B 21/06

[52] U.S. Cl. ..... 272/118; 272/134; 272/143; 272/DIG. 4

[58] Field of Search ..... 272/134, 118, 144, DIG. 4, 272/117, 93, 109, 142; 128/25 R

[56] References Cited

U.S. PATENT DOCUMENTS 3,912,261 10/1975 Lambert ..... 272/134 X 4,125,258 11/1978 McArthur ..... 272/144 X

*Primary Examiner*—Richard C. Pinkham

*Assistant Examiner*—William R. Browne

*Attorney, Agent, or Firm*—Victor J. Evans & Co.

[57] ABSTRACT

An lower abdominal twist machine including a frame having weights slidably mounted in a cage with the weights drivably connected to a rotatably mounted seat for an individual together with a handgrip on the frame which is grasped by the individual in a seated condition on the seat so that the seated individual grasping the handgrip may twist the lower portion of the body in either direction rotating the seat against the resistance offered by the weights thereby exercising the abdominal region of the individual's torso.

10 Claims, 5 Drawing Figures

97
94
96
87
192
93
98
99
101
88
96
94
157
31
48
102
106
103
104
78
158
159
47
I
161
53
52
51
171
156
29b
46
49
72a
72
162
163
43
164
44a
44b
73a
44c
73
166
44
74
167
76
168
77
169
31

LOWER ABDOMINAL TWIST MACHINE

BACKGROUND OF THE INVENTION

A wide variety of exercise machines are available today which are of the stationary type and which permit an individual to perform body exercises against the resistance offered by weights which are suitably arranged to be lifted by the efforts expanded by the individual during the exercise. While such present day machines generally provide body toning and some muscular development they are as a rule of the generalized type and do not focus on specific areas of the individual's body and more particularly on a certain muscle or at least a group of muscles. As a result, efforts expended by the individual during exercise during the use of such present day machines are wasted to an extent where specific muscular development is desired and therefore limit the extent of muscular development which an individual may desire. Thus, progress is slow for an individual so that not only is time wasted but there is a tendency for the individual to lose interest when such muscular development is slow in coming.

In addition, such present day machines are usually quite complex in construction and therefore expensive requiring a high initial investment and frequent maintenance. Furthermore, the use of such machines lack the ability to properly develop a particular muscle or groups of muscles so that regardless of the time spent in the use of such machines the ultimate goal is never obtained.

OBJECTS AND SUMMARY OF THE INVENTION

Accordingly, a primary object of this invention is to provide a new and novel machine for exercising the upper waist area of an individual's body.

Another object of this invention is to provide a new and novel machine for exercising the muscles in the abdominal region of the individual's torso permitting the efforts expended by the individual doing exercise to be focused completely on that particular region of the individual's body.

A further object of this invention is to provide a new and novel machine for exercising the abdominal region of an individual's body which is relatively simple and in expensive in construction, which is capable of prolonged use without breakdown and which maximizes the proper development of the individual's abdominal region in a highly efficient and proper manner.

The objects of this invention and other related objects are accomplished by providing an apparatus which includes a frame having a weight cage in which weight means are slidably mounted for vertical movement from a rest position. A seat is provided for an individual on the frame which is mounted for rotary movement throughout an arcuate path and handgrips are provided on the frame accessible to an individual seated on the seat to permit rotation of the seat by an individual in the seated position. Drive means are provided for drivably connecting the weights to the seat and the drive means are arranged to rotate the seat into a predetermined rotary position corresponding to the rest position of the weights and to permit the weights to be moved vertically upward during the rotary movement of the seat by the individual from the predetermined rotary position thereby providing exercise of the muscles of the abdominal region of the individual's body as a result of the resistance offered by the weights during the rotary movement of the seat.

Other objects and advantages of the invention will become apparent in the light of the following description taken in connection with the accompanying drawings.

DESCRIPTION OF THE PREFERRED EMBODIMENT

Figure 1:
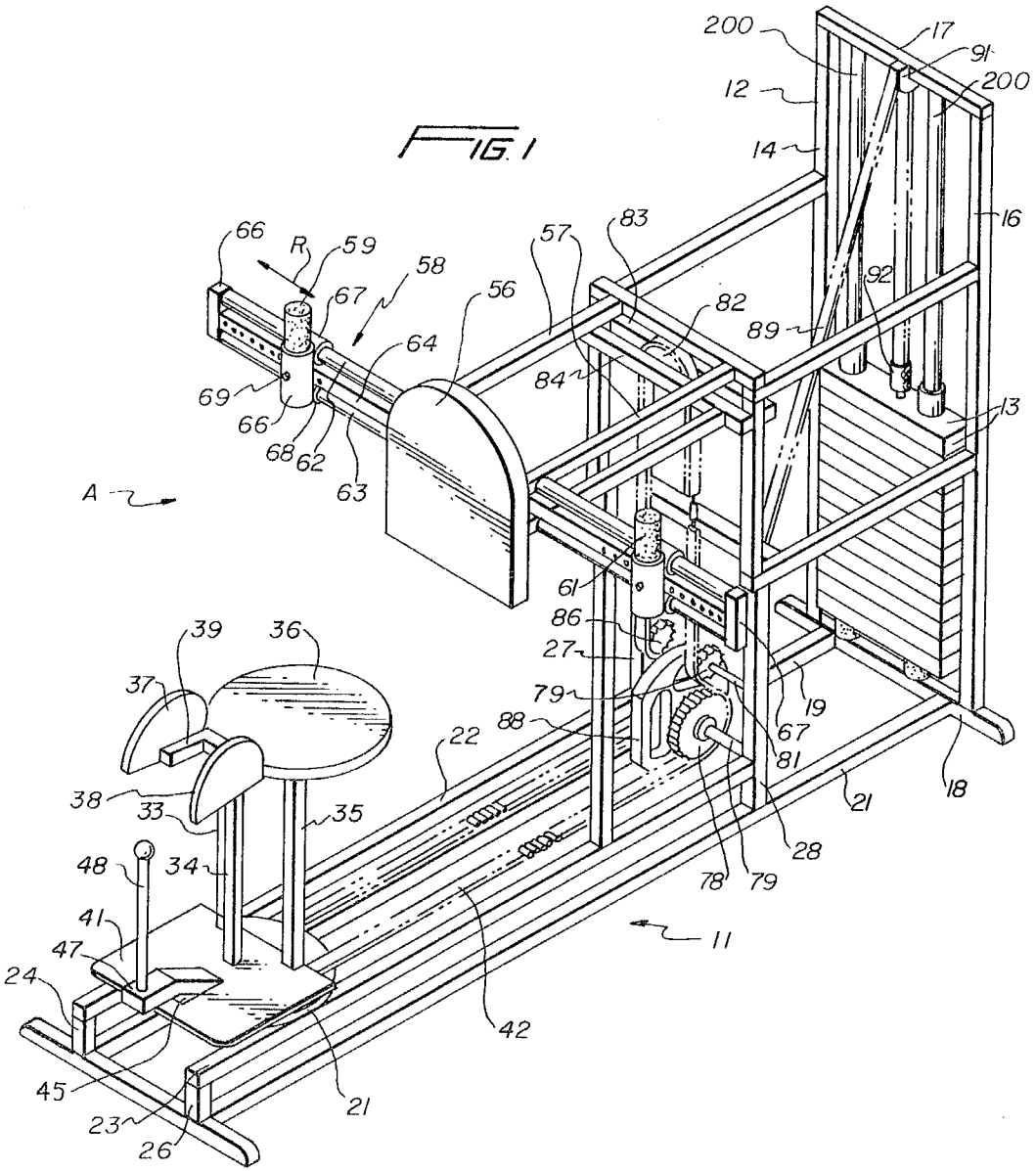
FIG. 1 is a perspective view of an abdominal twist machine constructed in accordance with the invention.

Referring now to the drawings and to FIG. 1 in particular there is shown an abdominal twist machine constructed in accordance with the invention and designated generally by the letter A. The machine A of FIG. 1 includes a frame designated generally by the numeral 11 which includes a weight cage 12 in which means comprising a plurality of weights 13 are slidably mounted for vertical movement from the rest position shown in FIG. 1 by being constrained on tubes 200.

The weight cage 12 includes vertically extending members 14, 16 and horizontally extending members 17, 18 and longitudinally extending frame members 19, 21 are connected at one end to the lower member 18.

At the other end of the frame 11 from the weight cage 12, seat means are provided remote from the weight cage 12 for supporting an individual with the individual's back to the weight cage 12. Means are provided for mounting the seat means for rotary movement throughout an arcuate path. More specifically, a platform 21, preferably circular in shape as shown best in FIG. 2, is mounted on a pair of longitudinally extending frame members 22, 23 supported at opposite ends on upstanding frame members 24, 26 and 27, 28 respectively.

Figure 2:
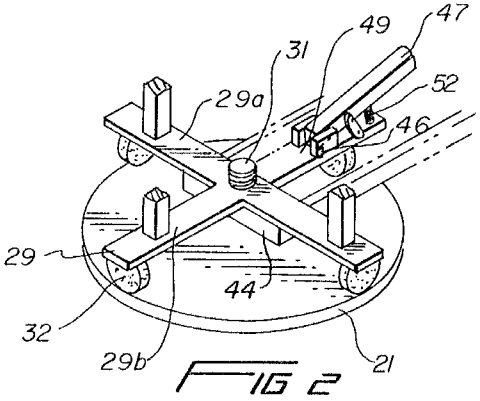
FIG. 2 is a perspective view of a portion of the machine of FIG. 1 specifically the roller seat support.

As shown best in FIG. 2, a base member 29 preferably comprising a pair of cross members **29*a*, 29*b* is rotatably supported on the platform 21 by means of a central axis 31 and the outer ends of the cross members 29*a*, 29*b* are each provided with a roller 32 for rolling engagement with the upper surface of the platform 21**.

An upstanding support comprising a plurality of support members 33, 34 and 35 are suitably mounted on the base member 29 on the upper ends of which is suitably mounted a seat 36 so as to accommodate an individual in a seated condition with his back to the weight cage 12. In the preferred embodiment, bracing members such as knee pads 37, 38 are suitably mounted on the seat 36 by means such as a U shaped bracket 39. The knee pads 37, 38 are arranged to be engaged by the knees of an individual seated on the seat 36 to prevent relative rotation between the seat 36 and the individual seated on the seat. Also, a footrest 41 is preferrably provided on and through the lower ends of the support members 33-35 and supported on the base member 29 to accommodate the feet of the individual seated on the seat 36 and isolate the feet from the moving components below footrest 41.

The machine of FIG. 1 includes drive means for drivably connecting the weights 13 to the seat means including the seat 36, the drive means being adapted to be rotated by the seat 36 into a predetermined rotary position corresponding to the rest position of the weight 13. More specifically, the drive means include a continuous chain 42 connected to the weight means 13 as will be described hereinafter and to the seat means by means of a sprocket 43 disposed beneath the platform 21 and fixally connected for rotation therewith to a plate member 44 as shown best in FIG. 2. Means are provided for connecting the base member 29 to the plate member 44 in a selected one of a plurality of rotary positions.

More specifically, the plate member 44 is provided with a plurality of apertures 44*a*, 44*b*, and 44*c* in the upper surface thereof which are arranged to be selectively engaged by a retractable pin 46 extending downwardly from one end of a manually operated lever 47 having a handle 48 as shown best in FIG. 1. The lever 47 is arranged to extend through an opening 45 in the foot rest 41 with the handle 48 extending upwardly for easy access by the individual on the seat 36. The pin 46 is arranged to extend through an aperture 49 in one of the cross members of the base member 29 such as cross member 29*b*.

Figures 4, 5:
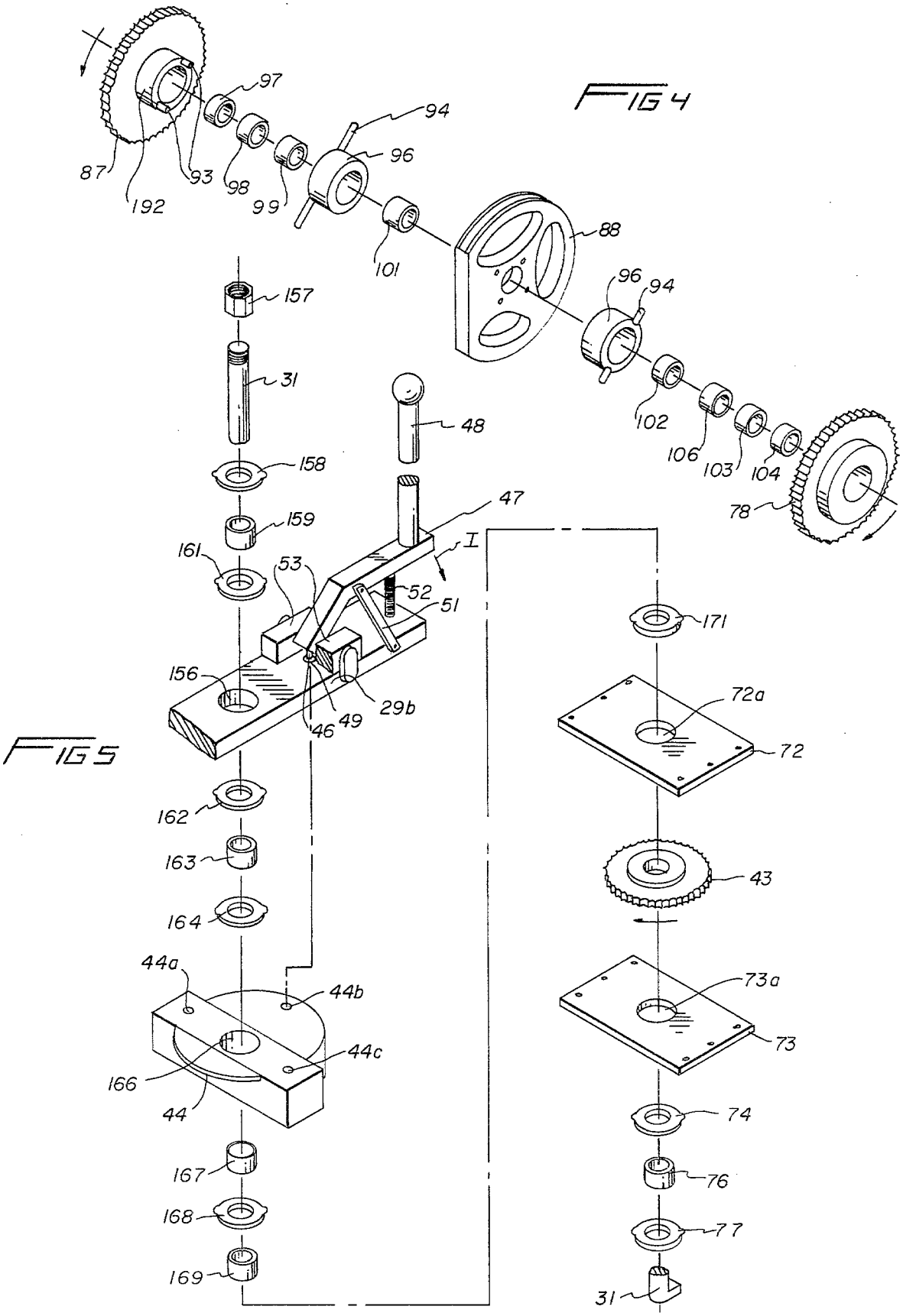
FIG. 4 is an exploded view of the parts included in the portion of the machine shown in FIG. 3.
FIG. 5 is an exploded view of the parts incorporated in a portion of the machine shown in FIG. 2 below the roller plate.

The operating lever 47 is pivotally supported on the cross member 29*b* by means such as brackets 51 and is yielding urged downwardly in one direction by means of spring 52 to retain the pin 46 in the selected one of the apertures 44*a*–44*c* in the plate member 44. Preferably guide means such as guide blocks 53 are provided on the cross member 29*b* to guide the lever 47 as it is pivotally moved with the pin 46 in alignment with the aperture 49 and the cross member 29*b*. Thus, movement of the lever 47 through the handle 48 in the direction of the arrow I as shown in FIG. 5 permits a rotary movement of the base member 29 relative to the plate member 44 and the sprocket 43 attached thereto so that the base member and consequently the seat 36 may be positioned in a selected one of the plurality of rotary positions relative to the plate member 44. When the selected rotary position is reached, an alignment occurs between the aperture 49 in the cross member 29*b* and the selected aperture 44*a*–44*c* in the plate member 44 whereupon the lever 47 is released and the pin 46 enters the selected aperture 44*a*–44*c* maintaining the base member 29 and consequently the seat 36 in the selected rotary position.

The machine of the invention as shown in FIG. 1 also includes a backrest 56 preferably padded for comfort against which the individual on the seat 36 may lean during use of the machine, the backrest 56 being preferably supported on the frame 11 by means such as horizontally extending members 57. The machine A also includes hand gripping means mounted on the frame accessible to an individual on the seat 36 to permit the individual to rotate the lower portion of the torso together with the seat 36. More specifically, a transversely extending trackway designated generally by the numeral 58 is supported on the frame 11 such as on the frame members 57. A pair of handgrips 59, 61 are slidably mounted on the trackway 58 which comprises rectangular framework including a pair of vertically spaced rods 62, 63 and an apertured transverse rod 64 therebetween. The rods 62-64 are interconnected at each end by end members 66, 67. Each of the handgrips 59, 61 includes a vertically extending sleeve 66 having a pair of horizontally extending vertically spaced sleeves 67, 68 mounted thereon for slidably accommodating the rods 62, 63 respectively. A pin 69 is provided for the sleeve 66 which is engageable with an aperture in the apertured rod 64 in the selected position of the handgrips 59, 61 after the adjusting movement of the handgrips in the direction of the double arrow R.

As shown in FIG. 5, the base member 29 includes a central aperture 156 for accommodating the axle 31. The various parts for permitting rotation of the seat 36 which are assembled together in the sequence shown in FIG. 5. include a nut 157, a washer 158, a bearing 159 and a washer 161 disposed above the base member 29. Beneath the base member 29 there is provided a washer 162, a bearing 163, and a washer 164 disposed above the plate member 44 which, as shown in FIG. 5, is provided with a central bore 166 aligned with the opening 156 in the base member 29 for accommodating the axle 31. Below the plate member 44 is provided a set collar 167, a washer 168, a bearing 169 and a washer 171.

The washer 171 is arranged below the platform 21 in association with a pair of plates 72, 73 provided with central openings 72*a*, 73*a* respectively between which the sprocket 43 is sandwiched and below the plate 73 is provided a washer 74, a bearing 76 and a washer 77.

Figure 3:
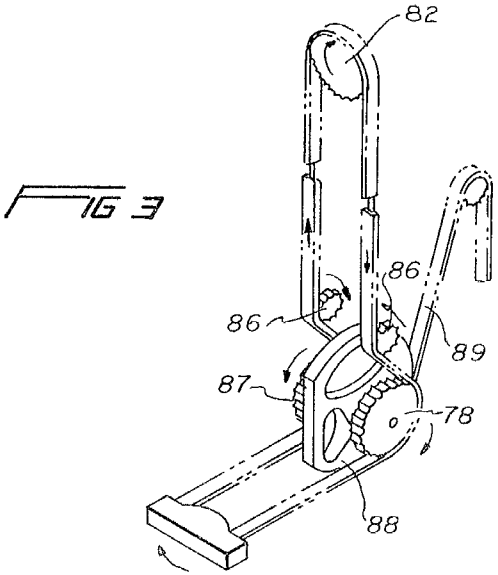
FIG. 3 is a perspective view of the drive transfer of the machine of FIG. 1 which transfers body rotation of the weights.

In the drive means of the invention, the sprocket 43 is engaged by the chain 42 and the chain extends around a sprocket 78 supported on a shaft 79 extending between the frame members 27, 28, around an idler sprocket 86 rotatably supported on split shafts 81 each supported between the frame members 27, 28 as shown best in FIGS. 1 and 3. The chain 42 then extends upwardly around a sprocket 82 rotatably supported between horizontally extending frame members 83, 84 and downwardly around an idler sprocket 86 also supported on shaft 81 and around sprocket 87 supported on shaft 79 back to the sprocket 43.

Between the sprockets 78, 87 is disposed a cam 88 of substantially D-shaped configuration as shown best in FIG. 4, the cam 88 being fixed to the shaft 79 for rotation with the sprockets 78, 87. Attached at one end to the cam 88 is a chain 89 which extends upwardly around a sprocket 91 mounted on the cross member 17 of the weight cage 12 and the other end of the chain 89 is suitably secured at its other end to the weights 13 through a slack adjuster 92.

Referring now to FIG. 4, each of the sprockets 78, 87 are provided on their inner surface with a sleeve 192 on the outer edge of which is provided a pair of diametrically spaced pins 93, the pins 93 being arranged to drivingly engage corresponding pins 94 on a sleeve 96 each secured on opposite sides of the cam 88 by means of threaded bolts or the like in operative association with the respective pins on each of the sprockets 78, 87. The parts which complete the assembly of FIG. 4 include a bearing 97, collars 98, 99 and a bearing 101 on one side of the cam 88. On the other side of the cam 88, the parts include bearings 102, 104 and collars 106. It should be understood that the angular relationship between each set of pins 93, 94 are such as to permit limited rotation of one of the sprockets 78, 87 when the other sprocket is being driven by the chain 42. That is to say, as best shown in FIG. 4, regarding the directional arrows provided thereon, since each of the sprockets 78, 87 are affixed to shaft 79, the chain setup will not work unless the pins 93 engage corresponding pins 94 on the sleeve only in one direction. For example, should the sprocket 43 rotate clockwise when viewed from a top plan view thereof, the sprocket on the righthand side will rotate in a direction opposite to that shown by sprocket 87. However, sprocket 78 will be the driving sprocket and it's pins will provide the beneficial cam rotation while the second sprocket 87 is merely being displaced as a function of chain advancement thereover and will not drivably engage the cam.

In the operation of the machine of the invention, with an individual seated on the seat 36 gripping the handgrips 59, 61, the lower portion of the individual's body is rotated in either direction from the center position shown FIG. 1 to rotate one of the sprockets 78, 87 together with cam 88 elevating the weights 13 so that the body movement opposes the resistance offered by the weights. It should be understood that in the rotary position of the seat 36 of FIG. 1, the pin 46 on the lever 47 is in the center aperture **44*b* of the plate member 44. If it is desired to begin exercise from a twisted position of the body to one or the other side, the lever 47 is moved in the direction of the arrow I to retract the pin 46 from aperture 44*b* and subsequently released after rotation of the seat 36 to permit the pin 46 to enter one or the other apertures 44*a*, 44*c***. It is most highly desired to have the weights attain a zero status or an at rest position when the body is twisted to one side or the other initially, since at that point rotation in an attempt to straighten the body out will cause work to be done on the weights and release of this tension will allow the body to go back to a twisted position to one side with no weight load being provided thereon. With the initialization of the lever so as to direct that seat into one extremity or the other, this form of the exercise can be easily accomplished. When the seat is linerly aligned with the longitudinal extent of the mechanism, and the pin for engaging the seat to the weights have been made, twisting from that position will cause the body to go through a zero setting each time the body is twisted from a maximum twist position on either side thereof through the center. The net affect of having no resistance on the body though providing a possible benefit, is not viewed as providing the same extensive benefits of starting up the exercise with the body already in the twisted position.

Having thus described the preferred embodiment of the invention it should be understood that numerous structural modifications and adaptations may be resorted to without departing from the spirit of the invention.

What is claimed is:

1. Apparatus for exercising the lower portion of an individual's body comprising, in combination, a seat means for supporting user of the apparatus, a frame, a weight cage attached to said frame, weight means slidably mounted for vertical movement from a rest position in said weight cage, means on said frame for mounting the seat means for rotary movement throughout an arcuate path, hand gripping means on said frame accessible to an individual seated on said seat means to assist rotation of said seat means by an individual seated thereon by providing a pressure bearing surface, drive means for drivably connecting said weight means to said seat means, said drive means being adapted to rotate said seat means from a predetermined rotary position corresponding to said rest position of said weight means and to move said weight means vertically upward during the rotary movement of said seat means by an individual along said arcuate path from said predetermined rotary position.

2. Apparatus in accordance with claim 1 including means for adjusting said predetermined rotary position of said seat means.

3. Apparatus in accordance with claim 1 including means for adjusting the position of said hand gripping means transversely of said frame.

4. Apparatus in accordance with claim 1 wherein said seat means include a seat and bracing means adjacent said seat engageable by the knees of an individual seated on said seat to prevent relative rotation between said seat and said individual on said seat.

5. Apparatus in accordance with claim 4 wherein said mounting means include a platform mounted on said frame, an upstanding support for said seat, said support including a base member rotatably mounted on said platform, a plurality of rollers on said base member arranged for rolling engagement with said platform and means for drivably connecting said base member to said drive means.

6. Apparatus in accordance with claim 5 wherein said means for drivably connecting said base member to said drive means includes adjustable means for connecting said base member to said drive means in a selected one of a plurality of predetermined rotary positions.

7. Apparatus in accordance with claim 6 wherein said adjustable means include a plate member connected to said drive means said plate member having a plurality of spaced apart apertures and retractable pin means on said base member engageable with a selected one of said apertures to position said base member in said selected one of said plurality of predetermined rotary positions.

8. Apparatus in accordance with claim 7 including manually operated means for yieldingly urging said retractable pin means into said selected one of said apertures.

9. Apparatus in accordance with claim 8 wherein said drive means comprises a first sprocket disposed below said plate member and rotatably driven thereby, a pair of sprockets, a chain wrapped therearound and extending rearwardly to said pair of sprockets being supported on a shaft having a cam disposed therebetween and said sprockets each provided with means for alternatively engaging said cam, said chain extending upwardly thereafter over a pair of idler sprockets each mounted on a second split shaft, said chain being received over another sprocket positioned above said pair of sprockets.

10. Apparatus in accordance with claim 9 wherein said means for alternatively engaging said cam comprise a sleeve provided with pins on each side of said cam and a sleeve provided with pins on each of said sprockets adjacent said respective sleeve on said cam for engagement with the pins on said respective cam sleeve, said pins on opposite sides of said cam being disposed substantially 180° apart whereby rotation of one sprocket provides driving engagement between the pins on said one sprocket sleeve and the pins on the adjacent cam sleeve, while the pins on the other of said sprocket sleeve are in slidable relationship and non driving engagement with the pins on the adjacent cam sleeve.

* * * * *